US006561444B1

(12) United States Patent
Yokomine et al.

(10) Patent No.: US 6,561,444 B1
(45) Date of Patent: May 13, 2003

(54) SHREDDER DRIVE CONTROL DEVICE AND METHOD OF DRIVINGLY CONTROLLING THE SHREDDER

(75) Inventors: Shunichi Yokomine, Tokyo-To (JP); Tomofumi Takahashi, Kasugai (JP); Takashi Hori, Kasugai (JP); Hiroaki Yoneyama, Kasugai (JP); Tadashi Abe, Kasugai (JP)

(73) Assignee: Kabushiki Kaisha Meiko Shokai, Tokyo-To (JP)

( * ) Notice: Subject to any disclaimer, the term of this patent is extended or adjusted under 35 U.S.C. 154(b) by 0 days.

(21) Appl. No.: 09/913,304

(22) PCT Filed: Feb. 16, 2000

(86) PCT No.: PCT/JP00/00847

§ 371 (c)(1),
(2), (4) Date: Aug. 13, 2001

(87) PCT Pub. No.: WO00/48737

PCT Pub. Date: Aug. 24, 2000

(30) Foreign Application Priority Data

Feb. 16, 1999 (JP) ..... 11-078268
Nov. 12, 1999 (JP) ..... 11-359621

(51) Int. Cl.[7] ..... B02C 25/00
(52) U.S. Cl. ..... 241/30; 241/36
(58) Field of Search ..... 241/30, 34, 35, 241/36, 236

(56) References Cited

U.S. PATENT DOCUMENTS 5,236,138 A * 8/1993 Stangenberg et al. ..... 241/36
5,248,100 A * 9/1993 Arakawa ..... 241/34

FOREIGN PATENT DOCUMENTS

| | | |
|---|---|---|
| JP | 8108087 | 4/1996 |
| JP | 938514 | 2/1997 |
| JP | 1043617 | 2/1998 |

* cited by examiner

*Primary Examiner*—Mark Rosenbaum
(74) *Attorney, Agent, or Firm*—Ladas & Parry

(57) ABSTRACT

A driving and controlling system for driving a shredding mechanism by a motor to shred paper sheets increases shredding capacity represented by the number of paper sheets that can be simultaneously shredded while limiting input current in an allowable range and reduces time necessary for shredding a predetermined number of paper sheets. The driving and controlling system comprises a motor (4) for driving a shredding mechanism (5) for shredding paper sheets (10), and a controller (1) interposed between the motor and a commercial power supply system (13) to control power to be supplied to the motor. The motor has a characteristic to reduce motor torque substantially linearly with the increase of operating speed for voltage applied thereto as a parameter. The controller controls the motor so that the operating speed of the motor decreases as the necessary torque of the shredding mechanism required for shredding paper sheets increases, and the power supplied from the commercial power supply system may not increase beyond a predetermined level.

23 Claims, 9 Drawing Sheets

SHREDDER DRIVE CONTROL DEVICE AND METHOD OF DRIVINGLY CONTROLLING THE SHREDDER

TECHNICAL FIELD

The present invention relates to a shredder provided with a shredding mechanism driven for shredding wastepaper by a motor and, more particularly, to a driving and controlling system for driving and controlling a shredding mechanism included in a shredder and capable of simultaneously shredding a small to a large number of paper sheets.

BACKGROUND ART

A generally known shredder comprises an induction motor, i.e., ac motor, driven by power supplied from a commercial power supply system of single-phase 100 V ac and 50 or 60 Hz, a reduction gear connected to the output of the motor and capable of reducing an input speed at a predetermined reduction ratio to a lower output speed and of increasing an input torque to a higher output torque, and a shredding mechanism, such as a rotary cutting mechanism, connected to the output side of the reduction gear.

FIG. 6 shows the speed-torque characteristic of the induction motor. The induction motor operates stably in a speed range between a point P6 corresponding to synchronous speed and a point P7 corresponding to stall torque. Therefore, the motor is operated in operating conditions represented by a line between the points P6 and P7. When load on the motor increases, the slip of the motor increases, current supplied to the motor increases and, consequently, a high torque is produced for shredding.

When the number of superposed paper sheets to be shredded simultaneously is increased and load on the induction motor, i.e., ac motor, employed in the known shredder is increased, the operating condition of the motor changes from the side of the point P6 corresponding to the synchronous speed toward the side of the point P7 corresponding to the stall torque and the current increases exponentially. Since power is supplied from a commercial power supply system to the motor, the voltage applied to the motor is unchangeable. Therefore, input power to the motor increases sharply in proportion to the current. To provide for such a condition, a lead-in cable connecting the shredder to the commercial power supply system must have a capacity large enough to withstand the high current.

If the shredder is overloaded and nothing is done to rectify the undesirable condition, the power supplied to the shredder will increase beyond the rated input power of the shredder or the operating speed of the motor decreases below the speed corresponding to the point P7 corresponding to the stall torque and stalls and the shredder is unable to exercise its function. Moreover, a current exceeding a current specified by the electrical appliance regulation law will flow through the service outlet and a circuit breaker will open the corresponding circuit to protect electrical appliances other than the shredder from overcurrents.

Generally, to avoid such a condition, the shredder is provided with means for stopping the motor before the torque of the motor reaches the stall torque at the point P7 and reversing paper sheets taken into the shredding mechanism to return the paper sheets to the feed side. If the shredder is thus reversed, shreds and scraps of the paper sheets subjected to shredding scatter in the shredding mechanism and around a feed unit, necessitating cleaning work.

Since a condition where the shredder is unable to function normally occurs if an excessively large number of paper sheets are fed simultaneously in a pile into the shredder, a reduced number of paper sheets are fed in a pile. However, if the shredder is used generally by unspecified people who do not necessarily have sufficient knowledge of the functions of the shredder, the interruption of shredding operation will occur very often, making the operation of the shredder very complicated. Those problems are attributable to a fact that it is difficult to control the operating speed and the torque of the induction motor optionally.

Furthermore, the conventional shredder employing an induction motor, i.e., an ac motor, has the following problems.

FIG. 9 shows the operating characteristic of a shredder provided with an induction motor as a driving means. FIG. 9 shows the variation of the operating speed of the motor with load loaded on the motor by wastepaper. In a nonloaded state P1 where any wastepaper is not fed to the shredder, the motor operates at an operating speed N1. In a fully loaded state P2 the motor operates at an operating speed N2. The slip of the induction motor increases when wastepaper is fed to the shredder and an actual load increases, and the operating speed decreases from N1 to N2. As obvious from FIG. 9, the induction motor has three states, i.e., a waiting state after the start of the motor in which wastepaper is not fed yet, a shredding state where the motor is operating in conditions between the states P1 and P2 on the characteristic curve and a stopped state where power is not supplied to the motor. The motor is operating at high operating speeds in most of the time whether or not wastepaper is fed to the shredder.

The induction motor is designed so as to operate at a high efficiency in a high-load region to operate under a maximum shredding load by using a current not exceeding a limit current of the commercial power supply system. Therefore, the efficiency of the induction motor is low when the induction motor operates in a low-load region. FIG. 10 shows the load-torque characteristic and the load-current characteristic of an induction of such a design. Suppose that the torque of the motor is T3 and a current I3 is supplied to the motor when the motor is in a state corresponding to a low-load point P3, and the torque of the motor is T4 and a current I4 is supplied to the motor when the motor is in a state corresponding to a high-load point P4. Then, $$(T3/I3)<(T4/I4) \tag{1}$$

When the motor is in the state corresponding to the high-load point P4, a voltage drop across the winding due to the resistance of the winding and the current I4 necessary for producing the torque T4 is large. The design of the winding of the motor is determined in anticipation of such a large voltage drop. However, although the intensity of the current I3 necessary for producing the torque T3 is low and the voltage drop across the winding is small when the motor is in the state corresponding to the low-load point P3, unnecessary power is supplied to the motor because the voltage applied to the motor is fixed and hence the efficiency is low. In FIG. 10, a curve A indicates motor current, a curve B indicates torque, and a curve C indicates excitation current.

FIG. 11 is a graph showing the variation of starting current required by an induction motor at start with time. A high starting current flows in a period between motor start time t8 and time t9 when the operating speed stabilizes.

The conventional shredder employing the induction motor, i.e., ac motor, has the nonloaded state P1 where any wastepaper is not fed to the shredder, the loaded state P1-P2 where the shredder is loaded with wastepaper and the operating speed of the motor decreases from N1 to N2, and the fully loaded state P2 where the shredder is operating under a full load condition as shown in FIG. 9. However, the motor is operating at high operating speeds in most of the time whether or not wastepaper is fed to the shredder. Therefore, the motor operates at substantially fixed high operating speeds regardless of load, so that the motor and the shredding mechanism generate noise and vibrations, which deteriorates environmental conditions significantly.

Since importance is attached to the high-load state when designing the induction motor for the shredder, the induction motor operates at the highest efficiency under a high load. Therefore, in the nonloaded state or the low-load state where the shredder is not operating for shredding, the motor operates at a low efficiency as shown in FIG. 10 and consumes much power wastefully. As is obvious from the relation between the motor current indicated by the curve A and the excitation current indicated by the curve C in FIG. 10, the ratio of the excitation current to the motor current in the state corresponding to the low-load point P3 is greater than that in the state corresponding to the high-load point P4.

Even if the motor is kept stopped while the shredder not in the shredding operation to suppress power consumption, the motor needs to be started every time wastepaper is fed to the shredder and the high starting current flows frequency and hence power consumption cannot be effectively reduced. If the high starting current as shown in FIG. 11 flows frequently, the motor is overheated to reduce the efficiency and the overheating of the motor creates a danger to the operator. Thus, any effective means have not been available.

DISCLOSURE OF THE INVENTION

To solve the foregoing problems, the present invention provides a driving and controlling system for a shredder for shredding paper sheets comprises a motor for driving a shredding mechanism for shredding paper sheets, and a control means interposed between the motor and a commercial power supply system to control power supplied to the motor, wherein the motor has a characteristic to reduce motor torque substantially linearly with the increase of operating speed for voltage applied thereto as a parameter, and the control means controls the motor so that the operating speed of the motor decreases as the necessary torque of the shredding mechanism required for shredding paper sheets increases, and the power supplied from the commercial power supply system may not increase beyond a predetermined level.

According to the present invention, the control means reduces the operating speed of the motor when supply power supplied to the control means from the commercial power supply system increases with the increase of the necessary torque of the shredding mechanism and approaches an allowable limit level to reduce input power supplied from the control means to the motor, maintaining a desired motor torque. Consequently, the supply power supplied from the commercial power supply system to the control means decreases. When the input power approaches the allowable limit level again, the operating speed is reduced further to maintain the same operation. When reducing the operating speed, the control means reduces principally the voltage component of the input power supplied from the control means to the motor. Therefore, the motor current can be increased, and an allowable motor torque at input power below the allowable limit level for the commercial power supply system increases with the decrease of the operating speed.

According to the present invention, the operating speed is reduced so that the input current is below the allowable limit level to make the motor produce a maximum torque at all times, and the number of paper sheets that can be simultaneously shredded can be increased, keeping the input current from the commercial power supply system below the allowable limit level, so that the frequency of interruption of the shredding operation due to overloading can be greatly reduced. According to the present invention, a combination of a maximum operating speed and a maximum torque can be selectively determined and controlled while the input current is kept below the allowable limit level. Therefore, a shredding time necessary for shredding the same number of paper sheets can be reduced. Since the operating speed can be increased to a maximum according to a necessary torque, keeping the supply current from the commercial power supply system below the allowable limit level, shredding speed can be increased beyond a conventional synchronous speed. Since a shredding speed can be previously determined regardless of the frequency of the commercial power supply system, the shredding mechanism need not be replaced with another one when the frequency of available power changes and the shredding characteristic remains unchanged regardless of frequency.

According to the present invention, the driving and controlling system is provided with a sheet detecting means for detecting paper sheets fed to the shredding mechanism, and the control means changes the operating mode of the motor on the basis of the result of a detecting operation of the sheet detecting means. The present invention solves the technical problems in the conventional shredder attributable to the employment of the induction motor, the shredder is set in a low-speed operating state or a stopping state when any paper sheets are not fed-to the shredding mechanism, noise and vibrations generated by the operating motor and the operating shredding mechanism can be reduced, power consumption is suppressed, energy can be saved and noise can be reduced.

BEST MODE FOR CARRYING OUT THE INVENTION

Preferred embodiments of the present invention will be described with reference to the accompanying drawings.

Figure 1:
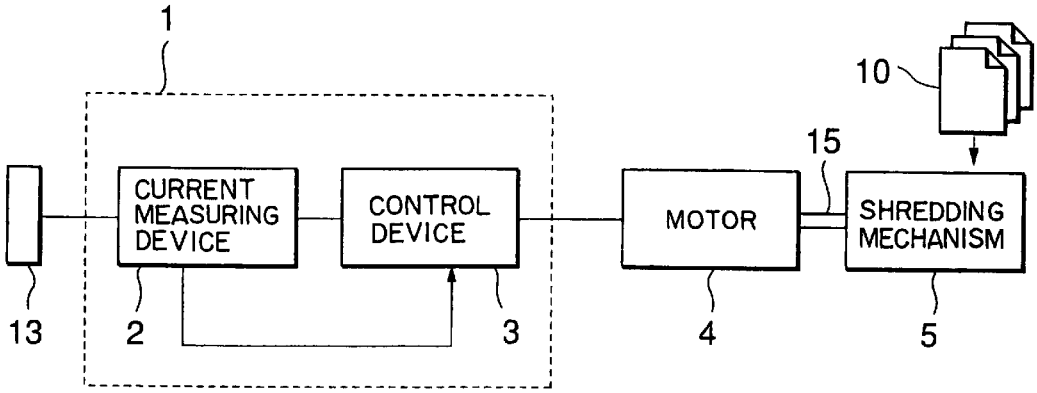
FIG. 1 is a block diagram of a driving and controlling system in a first embodiment according to the present invention for carrying out a shredder driving and controlling method in accordance with the present invention.

FIG. 1 is a block diagram of a driving and controlling system in a first embodiment according to the present invention for carrying out a shredder driving and controlling method in accordance with the present invention.

The driving and controlling system comprises a motor 4 for driving a shredding mechanism 5 for shredding paper sheets, and a controller 1 for driving and controlling the motor 4.

The motor 4 has a characteristic that decreases motor torque substantially linearly with the increase of operating speed for voltage applied thereto as a parameter. The motor 4 is, for example, a dc motor with brush, a dc brushless motor or a reluctance motor.

A reduction gear 15 capable of reducing an input speed at a predetermined reduction ratio to a lower output speed and of increasing an input torque to a higher output torque is connected to the output side of the motor 4. Thus, the motor 4 is connected through the reduction gear 15 to the shredding mechanism 5, such as a rotary cutting device.

The controller 1 comprises a current measuring device 2 for measuring supply current supplied from an ac power source 13, such as a commercial power supply system, and a control device 3 that provides a control signal for controlling the motor 4 on the basis of a current signal provided by the current measuring device 2.

The current measuring device 2 is an ac current transformer or the like. The current measuring device 2 measures the supply current from the commercial power supply system and gives a current signal representing the measured supply current to the control device 3.

If the motor 4 is a dc brushless motor, the control device 3 has a current circuit that rectifies the supply current from the commercial power supply system and supplies power through an inverter to the motor 4. The control device 3 compares the supply current represented by the output signal of the current measuring device 2 with an allowable current level and controls supply power from the commercial power supply system so that the supply power may not increase beyond a predetermined allowable power level. If the supply power supplied from the commercial power supply system after a pile of superposed paper sheets 10 has been fed to the shredding mechanism 5 exceeds the allowable power level, the control device decreases the voltage applied to the motor 4 by decreasing the link voltage of the inverter or reducing the pulse width of a PWM wave to reduce the operating speed of the motor 4.

Figure 2:
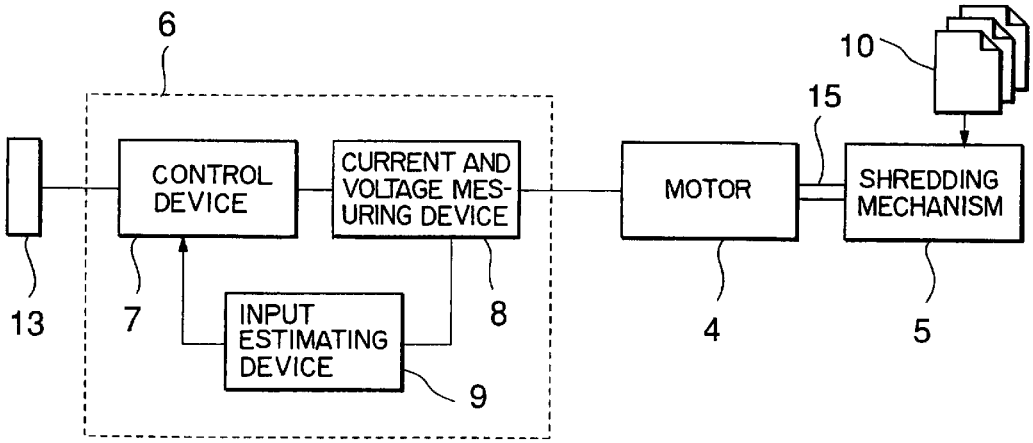
FIG. 2 is a block diagram of a driving and controlling system in a second embodiment according to the present invention.

FIG. 2 shows a driving and controlling system provided with a controller 6 instead of the controller 1 shown in FIG. 1. The controller 6 comprises a current and voltage measuring device 8 for measuring phase current supplied to a motor 4 and phase voltage, an input estimating device 9 that estimates supply power or supply current from a commercial power supply system on the basis of a phase current and a phase voltage measured by the current and voltage measuring device 8, and a control device 3 that provides a control signal for controlling the motor 4 on the basis of the output signal of the input estimating device 9.

The current and voltage measuring device 8 measures the phase current and the phase voltage of power supplied to the motor 4 by, for example, a current transformer and a voltage transformer, and gives signals representing the measured phase current and the measured phase voltage to the input estimating device 9. The input estimating device 9 multiplies the current signal and the voltage signal together to estimate supply power or supply current from the commercial power supply system and gives a signal representing an estimated supply power or an estimated supply current to a control device 7. Since the control device 7 consumes power scarcely, the estimation can be relatively easily achieved without significant error. The control device 7 compares the estimated supply power or the estimated supply current with a predetermined allowable power or current level. Other functions of the control device 7 are the same as those of the control device 2 shown in FIG. 1. The control device 7 controls the supply power or the supply current from the commercial power supply system so that the supply power or the supply current may not increase beyond the predetermined allowable power or current level.

Figure 3:
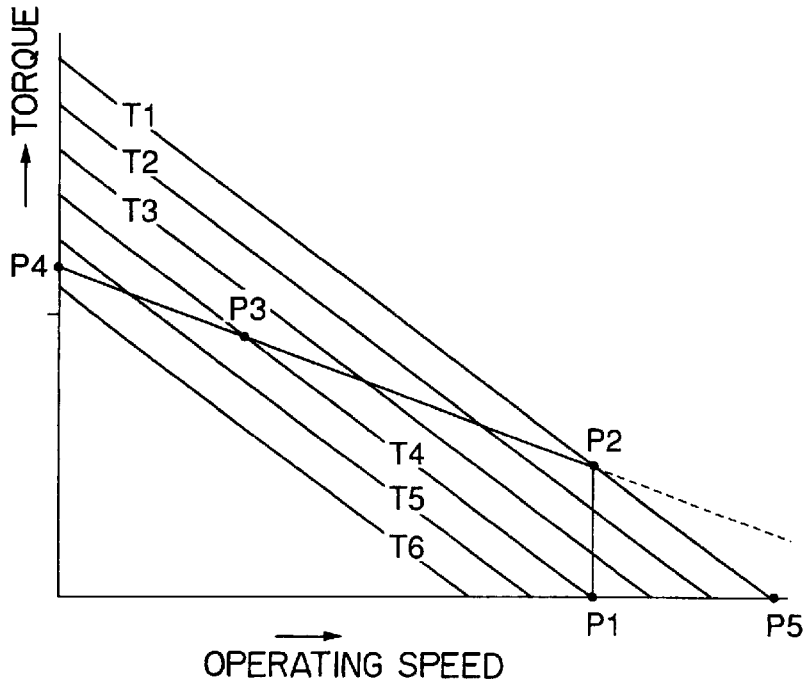
FIG. 3 is a graph showing characteristic curves of assistance in explaining the relation between the operating speed and the torque of a motor included in the driving and controlling system according to the present invention.

FIG. 3 is a graph showing the relation between the operating speed and the torque of the motors 4 shown in FIGS. 1 and 2. In FIG. 3, indicated at T1 to T6 are operating speed-torque characteristic curves for input voltage applied to the motor 4 as a parameter. Input voltages for the curves T1 to T6 increase from that for the curve T6 toward that for the curve T1. A line passing points P2 and P4 is a current limiting line indicating the relation between operating speed and maximum motor torque for an allowable upper limit level for the input current. For example, the voltage applied to the motor 4 is decreased by decreasing the operating speed from a value corresponding to a point P2 to a value corresponding to a point P3 and the operating condition of the motor 4 changes from that indicated by the curve T1 to that indicated by the curve T4. Consequently, the power supplied to the motor 4 decreases and the supply current from the commercial power supply system decreases. Thus, the motor torque can be increased by increasing the input current to the allowable upper limit value and, consequently, the point indicating operating condition on the current limiting line P2-P4 shifts to the left as the operating speed decreases.

A driving and controlling method according to the present invention controls the operation of the motor 4, for example, so that the operating condition of the motor 4 varies along a line P1-P2-P4. An operating speed at the point P1 is approximately equal to the synchronous speed of the conventional induction motor. Setting the point P1 at the synchronous speed is effective when it is possible that noise is generated and the shredding mechanism is deteriorated when the operating speed of the motor is higher than that at the point P1. In the range P1-P2 of operating condition, the voltage applied to the motor is regulated according to the load on the shredding mechanism 5, such as the thickness or hardness of paper sheets, to regulate the motor torque to operate the shredder for a normal shredding operation at a fixed high shredding speed.

Suppose that a pile of a large number of superposed paper sheets is fed to the shredding mechanism 5 and the input current increases beyond the allowable level. Then, the motor 4 is controlled so that the operating condition of the motor 4 in an operating range on a line P1-P2 changes for a operating condition in an operating range on a line P2-P4. That is, the motor 4 changes from an operating condition on the curve T1 to an operating condition on, for example, the curve T2 when the voltage applied to the motor 4 is decreased to reduce the operating speed of the motor 4. Then, the input current has an allowance enough to spare and the motor 4 is able to operated in this operating condition until the input current reaches allowable level again. Thus, the operating condition varies gradually along the current limiting line P2-P4 as the operating speed decreases.

When the shredding speed need not be very high, the motor may be controlled for operation in operating conditions indicated by, for example, a line P1-P3-P4. In this case, voltage regulation is unnecessary while the motor is operating in an operating condition in a range indicated by a line P1-P3. When noise and the deterioration of the shredding mechanism are not problem even if the motor operates at a high operating speed. the motor may be controlled for operation in operating conditions indicated by, for example, a line P5-P2-P4. In this case, the shredding speed can be increased in a range in which the input current does not increase beyond the current limiting line in a range P5–P2.

Figure 4:
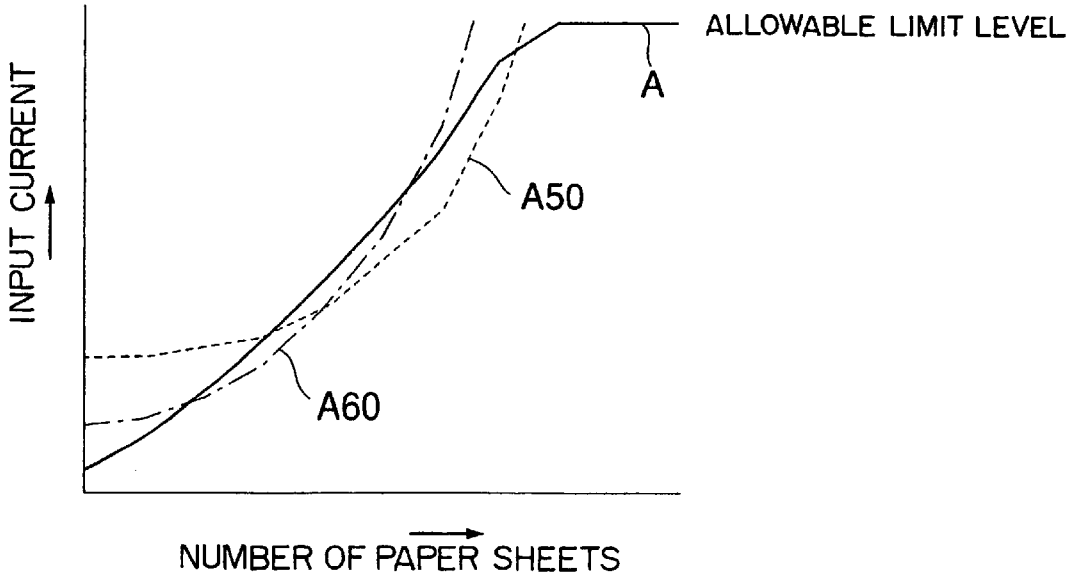
FIG. 4 is a graph showing the dependence of input current on the number of paper sheets to be shredded.

FIG. 4 is a graph showing the dependence of input current on the number of paper sheets to be shredded, in which a curve A is for an operation controlled by the driving and controlling method according to the present invention, a curve A50 is for an operation according to a conventional method using an induction motor operating on poser of 50 Hz, and a curve A60 is for an operation according to a conventional method using an induction motor operating on power of 60 Hz.

As obvious from FIG. 4, according to the present invention, it is possible to produce a maximum torque at all times by decreasing the operating speed so that the supply current from the commercial power supply system may not increase beyond the allowable limit level. As shown in FIG. 4, the number of paper sheets that can be shredded simultaneously can be increased without increasing the supply current from the commercial power supply beyond the allowable limit level, so that the frequency of interruption of the shredding operation due to overloading can be greatly reduced.

Figure 5:
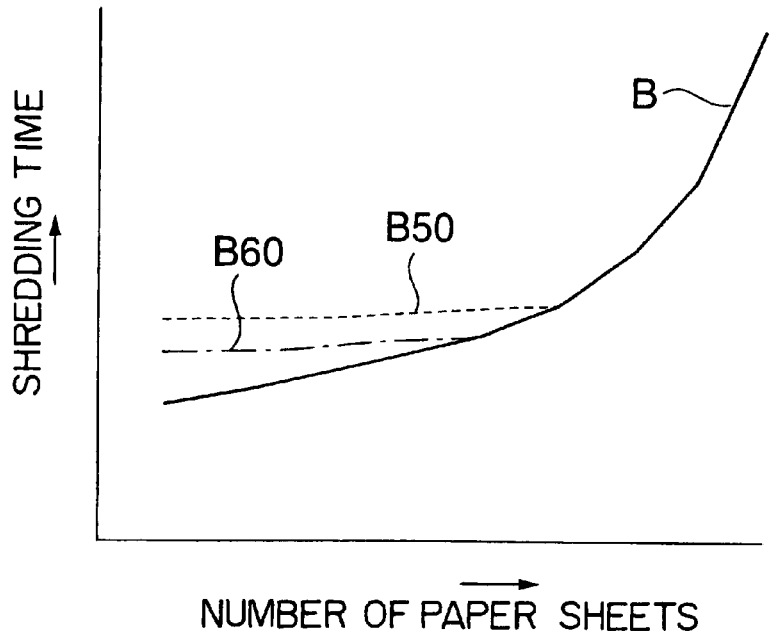
FIG. 5 is a graph showing the dependence of shredding time on the number of paper sheets to be shredded.
Figure 6:
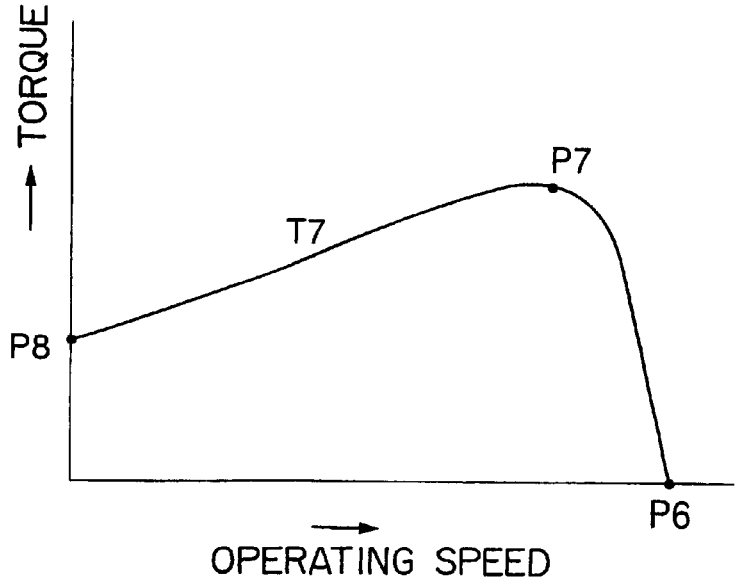
FIG. 6 is a graph showing the relation between the operating speed and the torque of an induction motor.

FIG. 5 is a graph showing the dependence of shredding time on the number of paper sheets to be shredded, in which a curve B is for an operation controlled by the driving and controlling method according to the present invention, a curve B50 is for an operation according to a conventional method using an induction motor operating on poser of 50 Hz, and a curve B60 is for an operation according to a conventional method using an induction motor operating on power of 60 Hz. According to the present invention, a combination of a maximum operating speed and a maximum torque can be selected with the supply current from the commercial power supply system kept below the limit level. Therefore, the present invention is makes the shredding mechanism shred a number of paper sheets in a shredding time shorter than that in which the conventional shredding mechanism is able to shred the same number of paper sheets. Since the operating speed can be increased to the upper limit keeping the supply current from the commercial power supply system below the limit level according to the necessary torque, the shredding speed can be increased beyond the synchronous speed.

According to the present invention, a shredding speed can be determined beforehand regardless of the frequency of the commercial power supply system. Therefore, the shredding mechanism 5 need not be changed for another one when the frequency of available power changed, and a fixed shredding characteristic can be maintained regardless of the frequency of available power.

Driving and controlling systems in other embodiments according to the present invention will be described with reference to FIGS. 7, 8, 12, 13 and 14.

Figure 9:
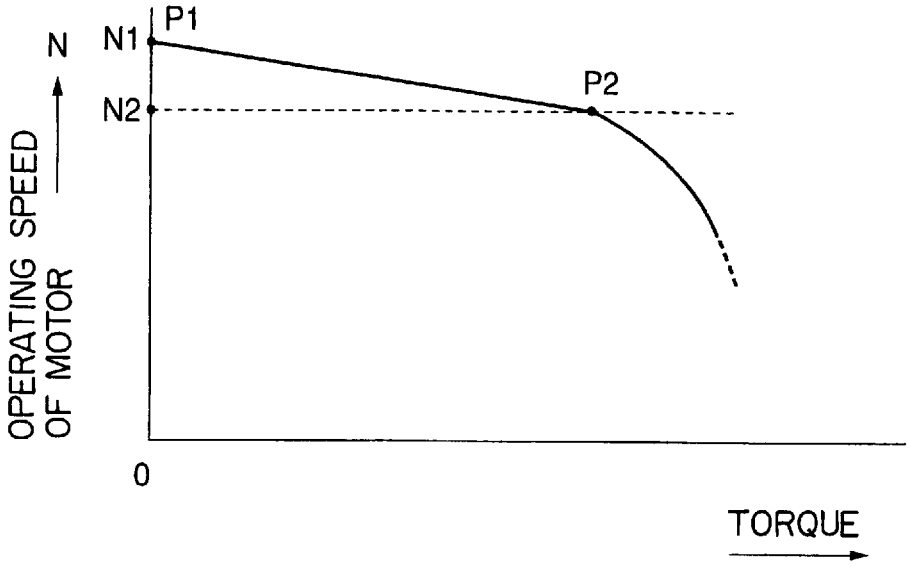
FIG. 9 is a graph showing the relation between the torque and the operating speed of an induction motor.
Figure 10:
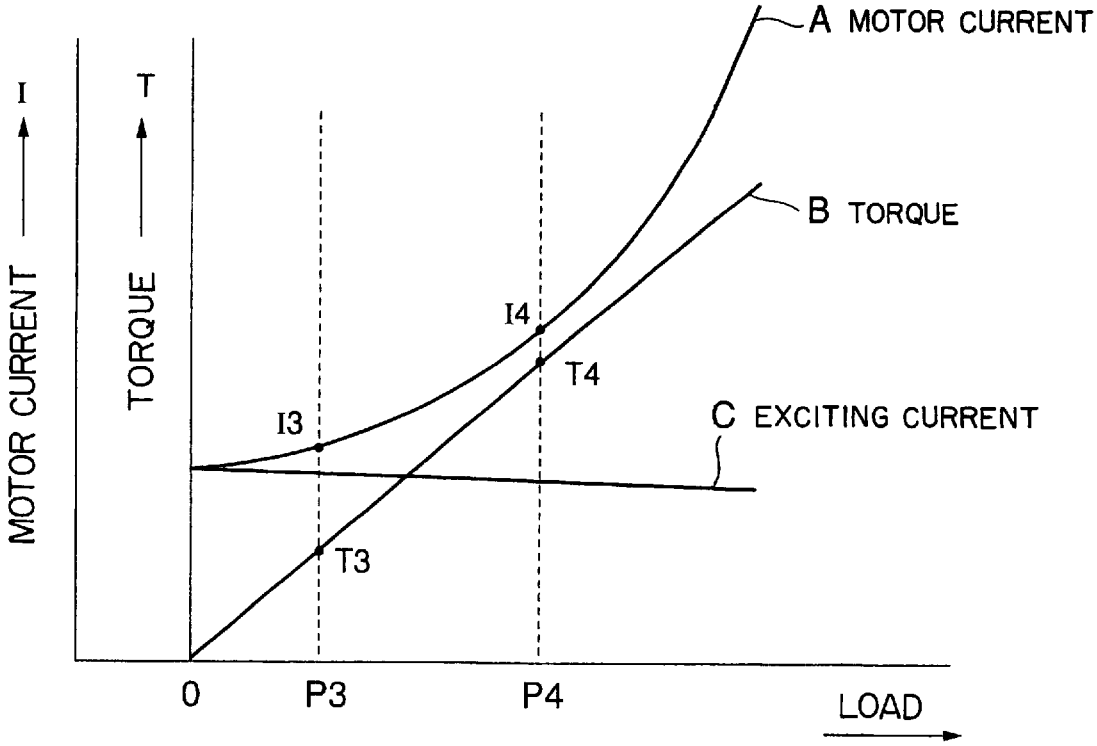
FIG. 10 is a graph showing the respective variations of current supplied to an induction motor and torque produced by the induction motor with load on the induction motor.
Figure 11:
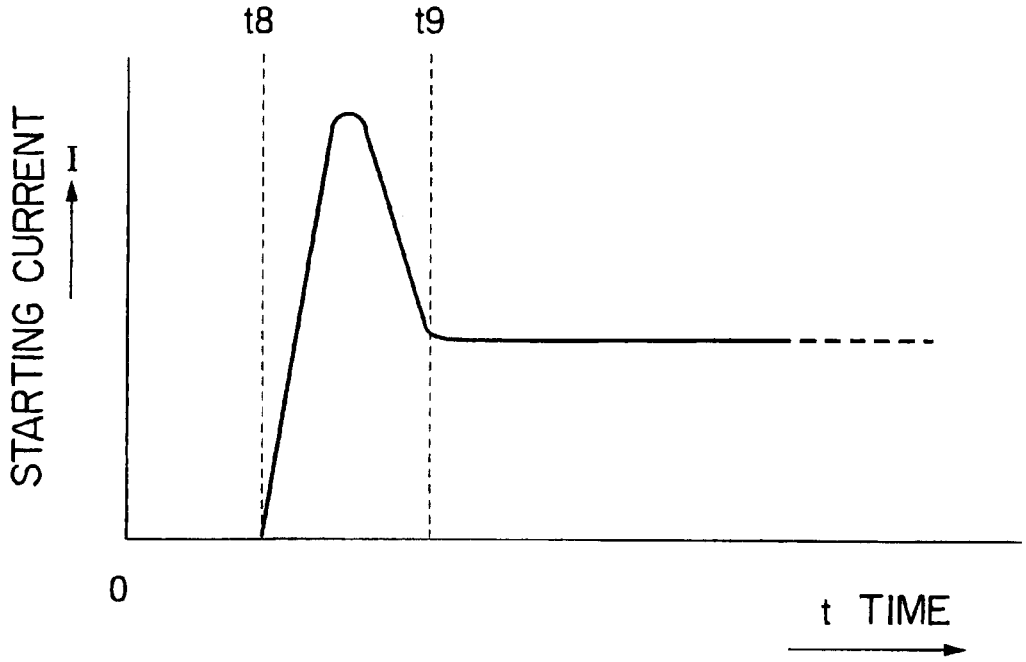
FIG. 11 is a graph showing the variation of current that flows through an induction motor with time after the start of the induction motor.

These embodiments are intended to solve the foregoing technical problems in the conventional shredder mentioned in connection with FIGS. 9, 10 and 11, i.e., the frequent starting of the motor every time paper sheets are fed to the shredding mechanism because the voltage of the commercial power supply system is applied directly to the motor, difficulty in the effective reduction of power consumption due to the frequent supply of the starting current to the motor, the overheating of the motor and the reduction of the efficiency of the motor due to the frequent supply of the high starting current to the motor, and the creation of a danger to the operator.

Figure 12:
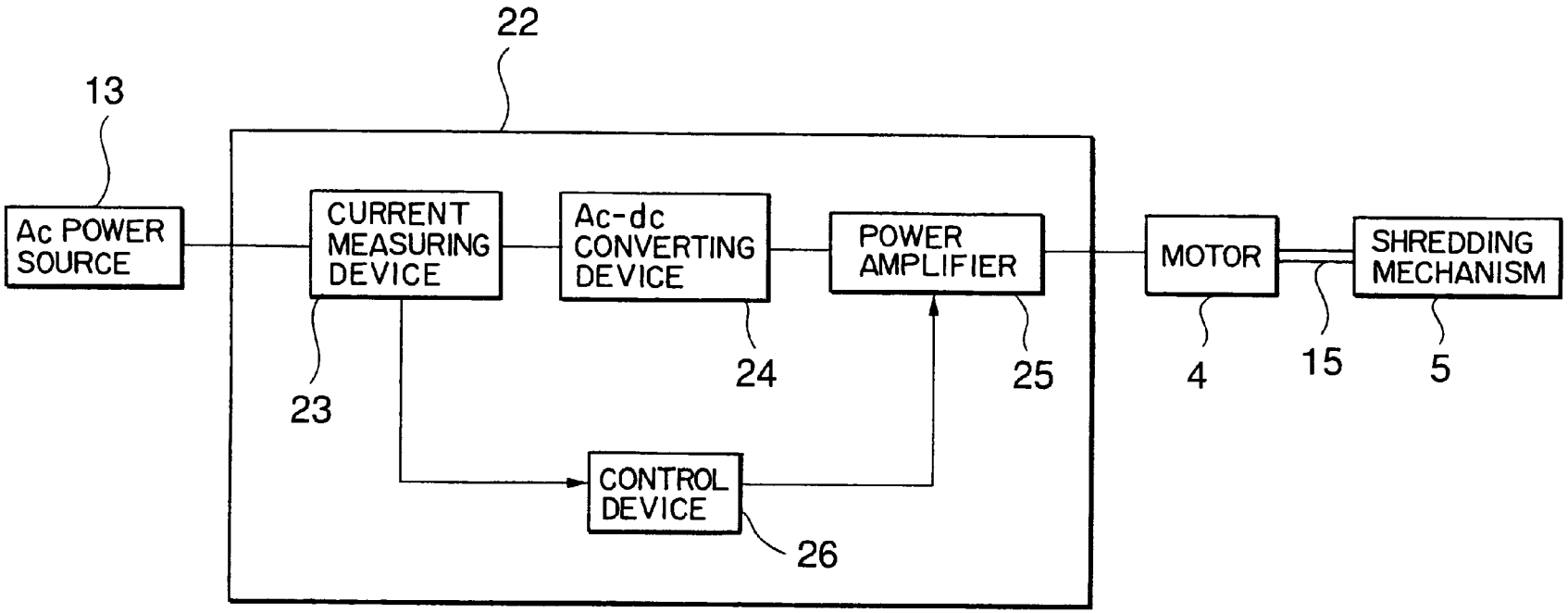
FIG. 12 is a block diagram of a driving and controlling system in a second embodiment according to the present invention for carrying out a shredder driving and controlling method in accordance with the present invention.

Referring to FIG. 12, a driving and controlling system in a second embodiment according to the present invention comprises a motor 4 for driving a shredding mechanism 5 for shredding paper sheets, and a controller 22 for driving and controlling the motor 4. As explained previously with reference to FIG. 3, the motor 4 has a characteristic to reduce motor torque substantially linearly as operating speed increases for voltage applied thereto as a parameter.

The controller 22 comprises a current measuring device 23 for measuring supply current supplied from a commercial power supply system, such as an ac power source 13, an ac-dc converting device 24, a power amplifier 25, and a control device 26 for making the power amplifier 25 produce a control signal for controlling the motor 4 on the basis of a current measurement signal provided by the current measuring device 23.

As shown in FIG. 12, the current measuring device 23 is interposed between the ac power source 13 and the ac-dc converting device 24. The current measuring device 23 is a current transformer or the like. The current measuring device 23 measures a supply current that flows from the ac power source 13 to the ac-dc converting device 24 and gives a signal to the control device 26. The control device 26 estimates the magnitude of motor load on the basis of the intensity of the supply current measured by the current measuring device 23 to determine whether or not any paper sheets are fed to the shredding mechanism 5. Then, the power amplifier 25 changes the operating condition of the motor 4 according to the estimated magnitude of motor load determined by the control device 6.

If the driving and controlling system is provided with a voltage measuring device in addition to the current measuring device 23, a decision as to whether or not any paper sheets are fed to the shredding mechanism 5 can be more accurately determined on the basis of the level of the supply power.

Figure 7:
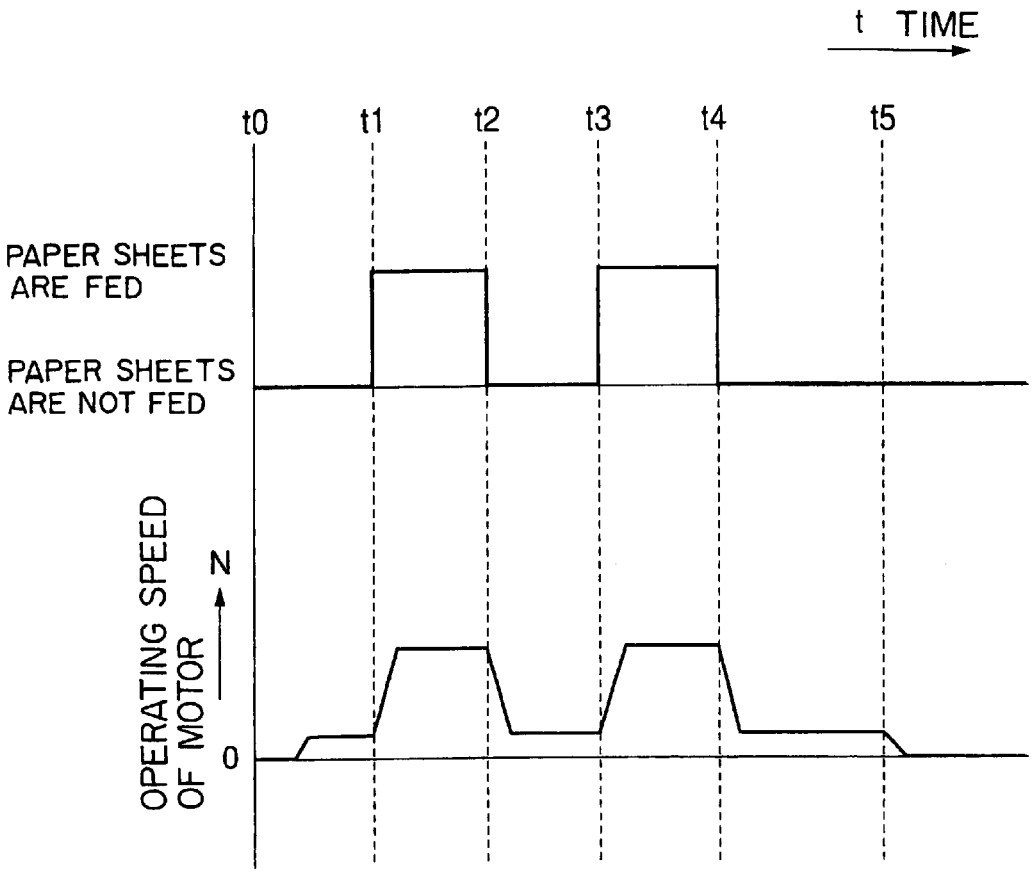
FIG. 7 is a time chart of assistance in explaining the driving and controlling method according to the present invention and the driving and controlling system for carrying out the same.

FIG. 7 is a time chart of assistance in explaining a control operation to be carried out by the driving and controlling system in the second embodiment. When any paper sheets to be shredded is fed into the shredding mechanism, the motor 4 is stopped or kept operating at a low operating speed. When the controller 22 decides that paper sheets are fed into the shredding mechanism from the signal provided by the current measuring device 23, the operating speed of the motor 4 is raised for a shredding operation in periods between times t1 and t2 and between times t3 and t4. When the controller 22 decides that any paper sheets are not fed into the shredding mechanism from the signal provided by the current measuring device 23, the operating speed of the motor 4 is lowered for an idling operation in a period between times t2 and t3. If the idling operation is continued for a time exceeding a predetermined time, the operating speed of the motor 4 is decreased and, eventually, the motor 4 is stopped at time t5. The motor 4 may be stopped instead of continuing the idling operation.

In the second embodiment, the controller 22 is interposed between the commercial power supply system and the motor 4 and the operating speed of the motor 4 can be varied by the controller 22. Since the motor 4 can be started without supplying any high starting current to the motor 4, the motor 4 will not be overheated and the efficiency of the motor will not be reduced by overheating. The motor is kept in the idling operation or stopped when any paper sheets are not fed into the shredding mechanism to reduce noise and vibrations generated by the motor 4 and the shredding mechanism are reduced and power consumption can be effectively reduced. Any suitable one of a dc brush motor, a dc brushless motor or a reluctance motor may be used according to a desired purpose. Since the motor 4 is a dc motor, a dc brushless motor or a reluctance motor and not an induction, the operating speed of the motor 4 can be varied by the controller 22.

Figure 8:
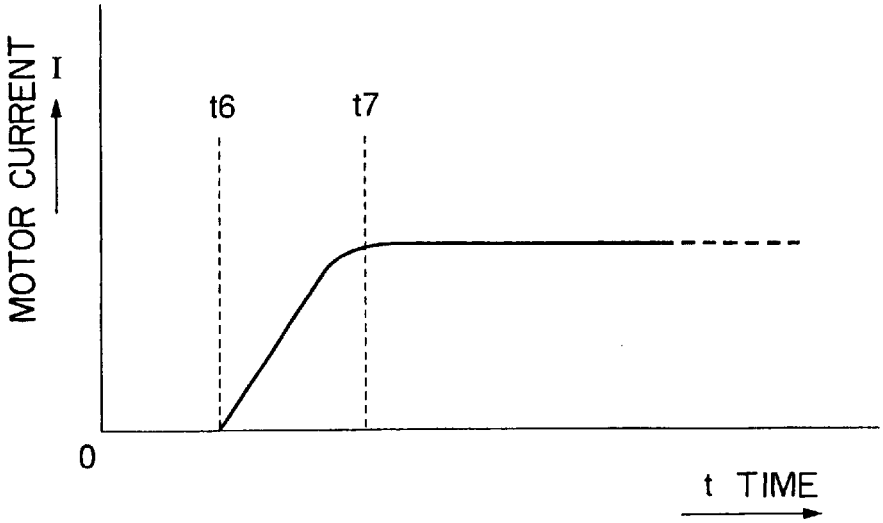
FIG. 8 is a graph showing the variation of current that flows through a motor with time.

FIG. 8 is a graph showing the variation of current that flows through the motor with time at the start of the motor controlled by the controller 22. Where as the current supplied to the induction motor of the conventional driving and controlling system increases as shown in FIG. 11 at the start of the induction motor, the current supplied to the motor of the driving and controlling system in the second embodiment increases gradually and does not have any peak in a period from time t6 when the motor is started to time t7 when the operating speed of the motor stabilizes. Consequently, it is possible to avoid overheating the motor 4 by the frequent supply of a high-intensity starting current to the motor 4, the deterioration of the efficiency of the motor 4 due to the overheating of the motor 4, and the creation of a danger by the overheating of the motor 4.

A driving and controlling system in a third embodiment according to the present invention having a controller 22 in a modification of the controller 22 shown in FIG. 12 will be described with reference to FIG. 13.

Figure 13:
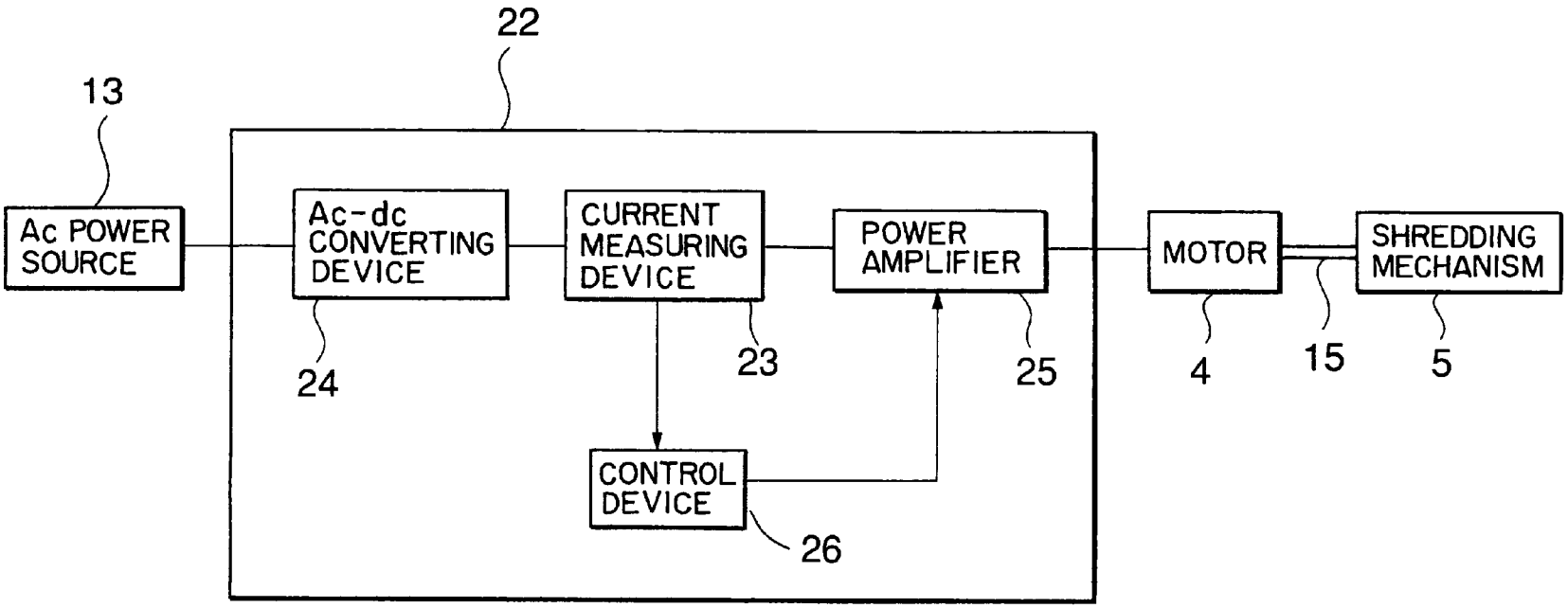
FIG. 13 is a block diagram of a driving and controlling system in a third embodiment according to the present invention.

The controller 22 of the driving and controlling system shown in FIG. 13 comprises an ac-dc converting device 24, a power amplifier 25, and a current measuring device 23 interposed between the ac-dc converting device 24 and the power amplifier 25. The current measuring device 23 is a current transformer or the like. The current measuring device 23 measures a dc current flowing through the power amplifier 25 and gives a signal to a control device 26. The dc current is a resultant current to be divided into currents for the phases of the motor 4. Since the motor current is proportional to load, the load on the motor can be estimated from the intensity of the motor current. The control device 26 decides whether or not any paper sheets are fed to the shredding mechanism on the basis of the estimated load on the motor 4 and determines an operating condition selectively. If the driving and controlling system is provided with a voltage measuring device in addition to the current measuring device 23, a decision as to whether or not any paper sheets are fed to the shredding mechanism can be more accurately determined on the basis of the level of the dc power.

A driving and controlling system in a fourth embodiment according to the present invention will be described with reference to FIG. 14. The driving and controlling system in the fourth embodiment has a controller 22 which is another modification of the controller 22 shown in FIG. 12.

Figure 14:
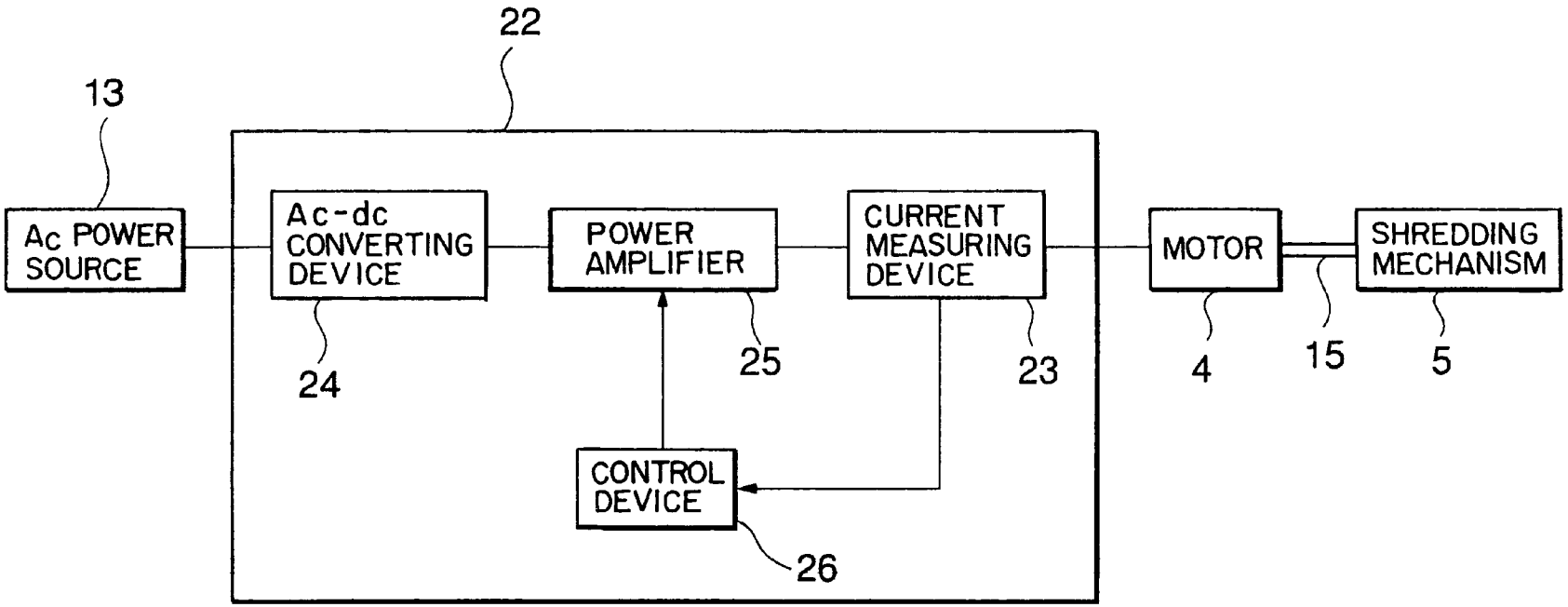
FIG. 14 is a block diagram of a driving and controlling system in a fourth embodiment according to the present invention.

The controller 22 of the driving and controlling system shown in FIG. 14 comprises a power amplifier 25, and a current measuring device 23 interposed between the power amplifier 25 and a motor 4. The current measuring device 23 is a current transformer or the like. The current measuring device 23 measures a motor current flowing from the power amplifier 25 to the motor 4 and gives a signal to a control device 26. Since the motor current is proportional to load, the load on the motor 4 can be estimated from the intensity of the motor current. The control device 26 decides whether or not any paper sheets are fed to the shredding mechanism on the basis of the estimated load on the motor 4 and determines an operating condition selectively. If the driving and controlling system is provided with a voltage measuring device in addition to the current measuring device 23, a decision as to whether or not any paper sheets are fed to the shredding mechanism can be more accurately determined on the basis of the level of the dc power.

The effects previously described with reference to FIGS. 3 to 5 can be exercised by making the controllers 22 shown in FIGS. 12 to 14 execute the functions of the controller 1 shown in FIG. 1.

A contact sensor or a noncontact sensor, such as an optical sensor, capable of detecting paper sheets may be disposed near the sheet feed opening of the shredder and the motor 4 may be controlled on the basis of the output signal of the contact or the noncontact sensor.

As apparent from the foregoing description, the present invention solves the technical problems in the conventional driving and controlling system employing an induction motor, keeps the motor in the low-speed operating condition or keeps the motor stopped when any paper sheets are not fed to the shredder to reduce noise and vibrations generated by the operating motor and the shredding mechanism and to suppress power consumption. Consequently, a large amount of energy can be saved and noise can be effectively reduced.

What is claimed is:

1. A driving and controlling system for a shredder for shredding paper sheets, comprising:

a motor for driving a shredding mechanism for shredding paper sheets; and a control means interposed between the motor and a commercial power supply system to control power supplied to the motor;

wherein the motor has a characteristic to reduce motor torque substantially linearly with the increase of operating speed for voltage applied thereto as a parameter, and the control means controls the motor so that operating speed of the motor decreases as a necessary torque of the shredding mechanism required for shredding paper sheets increases, and the power supplied from the commercial power supply system may not increase beyond a predetermined level.

2. The driving and controlling system according to claim 1, wherein the motor is a dc brush motor, a dc brushless motor or a reluctance motor.

3. The driving and controlling system according to claim 1 further comprising a current measuring means interposed between the commercial power supply system and the control means to measure current supplied from the commercial power supply system to the motor, and the control means controls power supplied to the motor on the basis of an intensity of current measured by the current measuring means.

4. The driving and controlling system according to claim 1 further comprising a current-and-voltage measuring means for measuring current supplied to the motor and voltage applied to the motor, and an input power estimating means for estimating power supplied from the commercial power supply system to the control means on the basis of a current and a voltage measured by the current-and-voltage measuring means;

wherein the control means controls input power supplied to the motor on the basis of estimated power estimated by the input power estimating means.

5. The driving and controlling system according to claim 1, wherein the control means is provided with a power supply circuit for rectifying an ac current supplied from the commercial power supply system and supplying power through an inverter to the motor.

6. The driving and controlling system according to claim 1 further comprising a paper sheet detecting means for detecting paper sheets fed to the shredding mechanism;

wherein the control means changes the operating condition of the motor according to a result of operation of the paper sheet detecting means.

7. The driving and controlling system according to claim 6, wherein the control means keeps the motor in a low-speed operating condition or keeps the motor stopped when any paper sheets to be shredded are not fed to the shredding mechanism.

8. The driving and controlling system according to claim 6, wherein the control means comprises an ac-dc converting device for converting an ac current supplied from the commercial power supply system into a corresponding dc current, a power amplifier for amplifying power to be supplied through the ac-dc converting device to the motor, a current measuring means for measuring current supplied from the commercial power supply system to the ac-dc converting device or a power measuring means for measuring power to be supplied from the commercial power supply system to the ac-dc converting device, and a control device for controlling power to be supplied to the motor through the power amplifier on the basis of a measurement measured by the current measuring means or the power measuring means; and the paper sheet detecting means determines whether or not any paper sheets to be shredded are fed to the shredding mechanism on the basis of a measurement measured by the current measuring means or the power measuring means.

9. The driving and controlling system according to claim 6, wherein the control means comprises an ac-dc converting device for converting an ac current supplied from the commercial power supply system into a corresponding dc current, a power amplifier for amplifying power to be supplied through the ac-dc converting device to the motor, a current measuring device for measuring current supplied from the ac-dc converting device to the power amplifier or a power measuring device for measuring power supplied from the ac-dc converting device to the power amplifier, and control device for controlling power to be supplied to the motor on the basis of a measurement measured by the current measuring means or the power measuring means; and the paper sheet detecting means determines whether or not any paper sheets are fed to the shredding mechanism on the basis of a measurement measured by the current measuring means or the power measuring means.

10. The driving and controlling system according to claim 6, wherein the control means comprises an ac-dc converting device for converting an ac current supplied from the commercial power supply system into a corresponding dc current, a power amplifier for amplifying power to be supplied through the ac-dc converting device to the motor, a current measuring means for measuring current supplied from power amplifier to the motor or a power measuring means for measuring power supplied from the power amplifier to the motor, and a control device for controlling power to be supplied through the power amplifier to the motor on the basis of a measurement measured by the current measuring means or the power measuring means; and the paper sheet detecting means determines whether or not any paper sheets to be shredded are fed to the shredding mechanism on the basis of a measurement measured by the current measuring means or the power measuring means.

11. The driving and controlling system according to claim 6, wherein the paper sheet detecting means includes a contact or noncontact sensor capable of detecting paper sheets and disposed near a paper sheet feed opening through which paper sheets are fed into the shredding mechanism, and the control means changes the operating condition of the motor according to a result of detection made by the sensor.

12. A shredder for shredding paper sheets, comprising:

a shredding mechanism for shredding paper sheets;

a motor for driving the shredding mechanism; and a control means interposed between the motor and a commercial power supply system to control power to be supplied to the motor;

wherein the motor has a characteristic to reduce motor torque substantially linearly with the increase of operating speed for voltage applied thereto as a parameter, and the control means controls the motor so that operating speed of the motor decreases as a necessary torque of the shredding mechanism required for shredding paper sheets increases, and the power supplied from the commercial power supply system may not increase beyond a predetermined level.

13. A driving and controlling method of driving and controlling a shredder for shredding paper sheets by means of a driving and controlling system for driving and controlling the shredder;

wherein the driving and controlling system comprises:

a motor for driving a shredding mechanism for shredding paper sheets;

a control means interposed between the motor and a commercial power supply system to control power supplied to the motor; and the motor has a characteristic to reduce motor torque substantially linearly with the increase of operating speed for voltage applied thereto as a parameter, and wherein the driving and controlling method comprises:

controlling the motor by the control means so that the operating speed of the motor decreases as a necessary torque of the shredding mechanism required for shredding paper sheets increases, and the power supplied from the commercial power supply system does not increase beyond a predetermined level.

14. The driving and controlling method according to claim 13, wherein the motor is a dc brush motor, a dc brushless motor or a reluctance motor.

15. The driving and controlling method according to claim 13, and further comprising interposing a current measuring means between the commercial power supply system and the control means to measure current supplied from the commercial power supply system to the motor, and controlling by the control means the power supplied to the motor on the basis of an intensity of current measured by the current measuring means.

16. The driving and controlling method according to claim 13, wherein the driving and controlling system further comprises a current-and-voltage measuring means for measuring current supplied to the motor and voltage applied to the motor, and an input power estimating means for estimating power supplied from the commercial power supply system to the control means on the basis of a current and a voltage measured by the current-and-voltage measuring means; and the driving and controlling method further comprises controlling the power supplied to the motor on the basis of estimated power estimated by the input power estimating means.

17. The driving and controlling method according to claim 13, and further comprising rectifying with a power supply circuit in the control means an ac current supplied from the commercial power supply system and supplying the power through an inverter to the motor.

18. The driving and controlling method according to claim 13, wherein:

the driving and controlling system further comprises a paper sheet detecting means for detecting paper sheets fed to the shredding mechanism; and the driving and controlling method further comprises changing an operating condition of the motor according to a result of operation of the paper sheet detecting means.

19. The driving and controlling method according to claim 18, and further comprising keeping the motor in a low-speed operating condition or keeping the motor stopped with the control means when any paper sheets to be shredded are not fed to the shredding mechanism.

20. The driving and controlling method according to claim 18, wherein the driving and controlling method further comprises converting an ac current supplied from the commercial power supply system into a corresponding dc current with an ac-dc converting device, amplifying power supplied through the ac-dc converting device to the motor with a power amplifier, measuring current supplied from the commercial power supply system to the ac-dc converting device with a current measuring means or measuring power supplied from the commercial power supply system to the ac-dc converting device with a power measuring means, controlling power supplied to the motor through the power amplifier on the basis of the measuring, and determining with the paper sheet detecting means whether or not any paper sheets to be shredded are fed to the shredding mechanism on the basis of a measurement measured by the current measuring means or the power measuring means.

21. The driving and controlling method according to claim 18, wherein the driving and controlling method further comprises converting an ac current supplied from the commercial power supply system into a corresponding dc current with an ac-dc converting device, amplifying power to be supplied through the ac-dc converting device to the motor with a power amplifier, measuring current supplied from the ac-dc converting device to the power amplifier with a current measuring device or measuring power to be supplied from the ac-dc converting device to the power amplifier with a power measuring device, controlling power to be supplied to the motor on the basis of a measurement measured by the current measuring device or the power measuring device, and determining with the paper sheet detecting means whether or not any paper sheets are fed to the shredding mechanism on the basis of.

22. The driving and controlling method according to claim 18, wherein the driving and controlling method further comprises converting an ac current supplied from the commercial power supply system into a corresponding dc current with an ac-dc converting device, amplifying power to be supplied through the ac-dc converting device to the motor with a power amplifier, measuring current supplied from power amplifier to the motor with a current measuring means or measuring power supplied from the power amplifier to the motor with a power measuring means, controlling power to be supplied through the power amplifier to the motor on the basis of the measuring, and determining whether or not any paper sheets to be shredded are fed to the shredding mechanism on the basis of the measuring.

23. The driving and controlling method according to claim 18, wherein the driving and controlling method further comprises detecting paper sheets disposed near a paper sheet feed opening through which paper sheets are fed into the shredding mechanism, and changing the operating condition of the motor according to a result of the detection.

* * * * *